US005664591A

United States Patent [19]

Potut

[11] Patent Number: 5,664,591

[45] **Date of Patent: *Sep. 9, 1997**

[54] HAIR CLIP WITH ANNULAR SPRINGS

[75] Inventor: Christian Potut, Arbent, France

[73] Assignee: C.S.P. Diffusion, société anonyme, Arbent, France

[ * ] Notice: The term of this patent shall not extend beyond the expiration date of Pat. No. 5,494,060.

[21] Appl. No.: 607,172

[22] Filed: Feb. 26, 1996

Related U.S. Application Data

[63] Continuation of Ser. No. 394,260, Feb. 24, 1995, Pat. No. 5,494,060.

[30] Foreign Application Priority Data

Feb. 28, 1994 [FR] France ..... 94 02408

[51] Int. Cl.[6] ..... A45D 8/20

[52] U.S. Cl. ..... 132/277; 132/279

[58] Field of Search ..... 132/277, 278, 132/279, 273, 275, 135; D28/38, 39, 40, 41; 24/67.7, 500, 507, 511

[56] References Cited

U.S. PATENT DOCUMENTS

| | | | |
|---|---|---|---|
| 2,133,145 | 10/1938 | Jones | 132/277 |
| 2,160,346 | 5/1939 | Valentine | 132/277 |
| 2,201,719 | 5/1940 | Eicher . | |
| 2,459,926 | 1/1949 | D'Alberto | 132/277 |
| 2,593,201 | 4/1952 | Saunders | 24/500 |
| 3,090,029 | 5/1963 | Stroebel | 24/500 |
| 4,508,124 | 4/1985 | Franzino | 132/277 |
| 5,052,086 | 10/1991 | Nasuno | 24/511 |
| 5,148,581 | 9/1992 | Hartmann | 24/511 |

FOREIGN PATENT DOCUMENTS

| | | | |
|---|---|---|---|
| 17268 | 4/1935 | Australia | 132/277 |
| 0516564 | 12/1992 | European Pat. Off. . | |
| 755662 | 11/1933 | France . | |
| 770805 | 9/1934 | France . | |
| 2748601 | 5/1979 | Germany | 132/277 |

*Primary Examiner*—Todd E. Manahan
*Attorney, Agent, or Firm*—William H. Eilberg

[57] ABSTRACT

A hair clip includes a first jaw operable by a first opening lever and hinged to a second jaw operable by a second opening lever. The hinge is provided by perforated lugs respectively projecting beyond inside surfaces of intermediate connecting areas between the levers and the jaws through which passes a connecting pin defining a transverse hinge axis. Two open annular springs disposed coaxially around the hinge axis pass through corresponding openings in the levers and bear in corresponding housings on outside surfaces of the jaws. The annular springs cover the perforated lugs. A tubular member covers the connecting pin between the two sets of perforated lugs. The resulting clip has a posterior side of considerably improved esthetic appearance.

14 Claims, 2 Drawing Sheets

HAIR CLIP WITH ANNULAR SPRINGS

This is a continuation of application Ser. No. 08/394,260, filed on Feb. 24, 1995, now U.S. Pat. No. 5,494,060.

BACKGROUND OF THE INVENTION

1. Field of the Invention

The present invention concerns hair clips such as are used by women's hairdressers, for example.

2. Description of the Prior Art

Prior art hair clips (see for example documents FR-A-770 805, FR-A-755 662 and U.S. Pat. No. 2,201,719) usually have a first jaw operable by a first opening lever to which it is attached in a first intermediate connecting area and a second jaw operable by a second opening lever to which it is attached by a second intermediate connecting area. The first and second intermediate connecting areas are hinged together to allow the first and second jaws to pivot relative to each other about a transverse axis between an open position and a closed position. Spring means urge the first and second jaws into their closed position.

In these prior art hair clips the spring means include a spring constituted by an elastic metal wire coiled around the transverse pivot axis. A first end of the metal wire is extended radially away from the axis and bears against the inside surface of the first opening lever. The second end of the metal wire extends radially away from the axis and bears against the inside surface of the second opening lever. The spring is prestressed so that its two projecting ends urge the opening levers away from each other and so urge the jaws towards their closed position.

A first drawback of this type of design is that it requires the use of a metal wire formed into a coil spring with contiguous turns. The contiguous turns constitute a plurality of narrow slots or housings in which water and other liquid products can stagnate. In long-term use the metal wire can be corroded by the moisture and the various hairdressing products used.

A second drawback of a design of this kind is that the spring is necessarily prestressed in the direction from its open position towards its closed position, in order to apply sufficient clamping force to the clip. If the clip is heated, the ends of the spring can become embedded in the plastics material pivot arms and deform them if the plastics material is sufficiently softened by the heat. Thereafter the clip does not work properly.

A major drawback of this known design is a result of the manner in which such clips are used: when they are in place, in the hair, they usually show their posterior part, i.e. the part constituted by the two inside surfaces of the opening levers, by the posterior side of the hinge area and by the metal wire spring. This is particularly unattractive, especially as the metal wire structure of the spring is clearly visible and gives a somewhat mechanical appearance to a hairclip that should primarily be decorative and ornamental.

Another prior art hairclip described in document EP-A-0 516 564 has pivot means with interengaging male and female parts and special molded spring members having a generally U-shape profile with longitudinal branches and attachment parts. The fabrication and assembly of special shape molded spring parts increase the cost of manufacture.

The problem to which the present invention is addressed is that of eliminating the use of spring means constituted by a metal wire coil spring which may show on the posterior surface of the clip, in order to remove the drawbacks of the prior art clip designs. The aim is to produce a clip whose visible side is of pleasing esthetic appearance, the various parts of the clip being suitable for decoration whilst retaining their function of clamping the clip jaws in a satisfactory manner.

The clip design of the invention must also be suitable for manufacture at low cost and in particular assembly must be quick and simple.

SUMMARY OF THE INVENTION

To achieve these and other objects, a hair clip in accordance with the invention comprises:

a first jaw operable by a first opening lever to which it is attached in a first intermediate connecting area, a second jaw operable by a second opening lever to which it is attached in a second intermediate connecting area, hinge means connecting said first and second intermediate connection areas to enable pivoting of said first and second jaws relative to each other about a transverse hinge axis between an open position and a closed position, spring means for urging said first and second jaws towards their closed position, wherein:

said hinge means include first and second perforated lugs respectively projecting beyond said first and second intermediate connecting areas and close together in the transverse direction along said hinge axis, third and fourth perforated lugs respectively projecting beyond said first and second intermediate connecting areas and close together in the transverse direction along said hinge axis but transversely spaced from said first and second perforated lugs with a stabilizing spacing E, and a coupling pin extending through the four perforated lugs to connect together the two jaws, said spring means include two identical open annular springs disposed around said hinge axis and coaxial with each other, having a common transverse axis parallel to said hinge axis, their respective ends bearing in corresponding housings on outside surfaces of said intermediate connecting areas of said jaws in front of said hinge axis and their intermediate parts extending through corresponding openings in said opening levers and surrounding the two sets of perforated lugs between said levers.

With a design of this kind the two annular springs cover the perforated lugs on the posterior side of the clip. Looking at the clip from the posterior side, the two annular springs and the connecting pin can be seen. In themselves, these components have a much more agreeable appearance than the metal wire coil spring with projecting ends which is visible on clips used until now.

The annular springs advantageously have a regular C-shape curved profile and, in the closed position, the regular curved C-shape profile is substantially circular.

The annular springs are preferably wider than the sets of perforated lugs to conceal the perforated lugs entirely in the hinge area visible between the two levers.

In a preferred embodiment of the invention, a tubular member fits over the connecting pin and joins the two sets of perforated lugs in order to conceal said connecting pin in the visible hinge area between the two levers. The tubular member can itself be decorated and, with its larger cross-section, of itself constitutes a decorative member which substantially improves the appearance of the clip.

Various jaw designs can be used with this design of the hinge and spring members in accordance with the invention.

Other objects, features and advantages of the present invention will emerge from the following description of specific embodiments of the invention given with reference to the appended drawings.

DETAILED DESCRIPTION OF THE PREFERRED EMBODIMENTS

Figure 1:
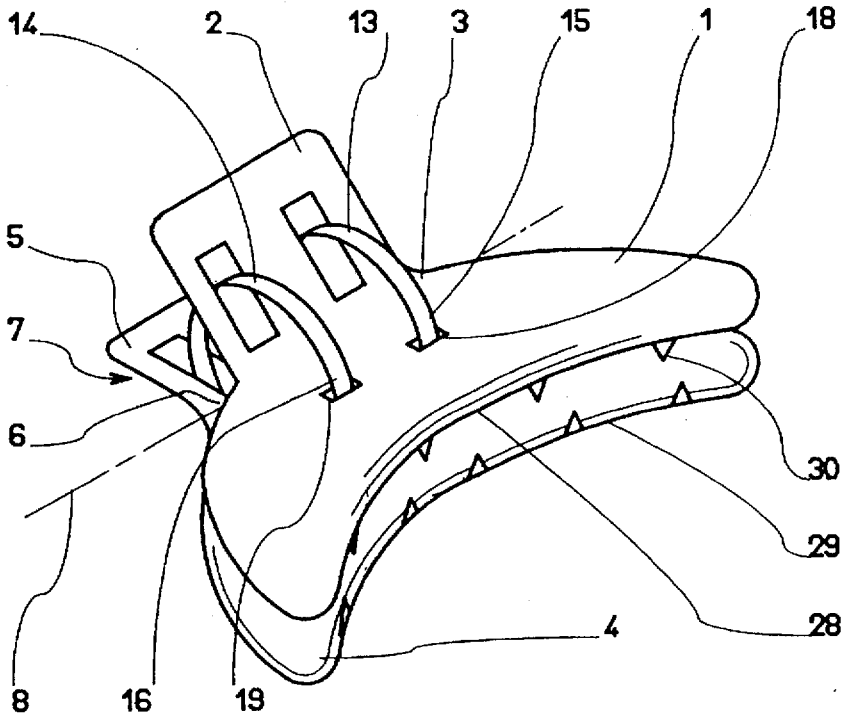
FIG. 1 is a perspective view of a first embodiment of hair clip in accordance with the invention, shown half-open.

Referring to the figures, a hair clip in accordance with the invention has a first jaw 1 operable by a first opening lever 2 to which it is attached in a first intermediate connecting area 3 and a second jaw 4 operable by a second opening lever 5 to which it is attached in a second intermediate area 6.

Figure 5:
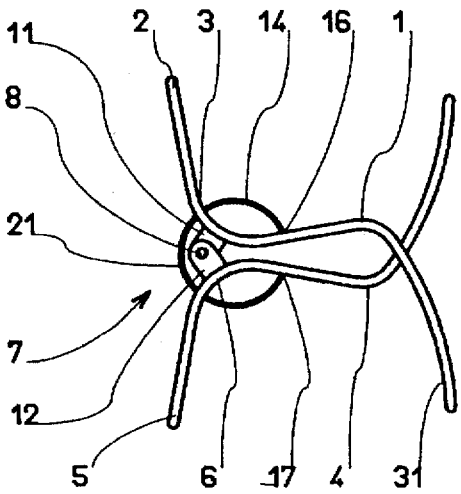
FIG. 5 is a side view of the clip from FIG. 2 shown in the closed position.
Figure 6:
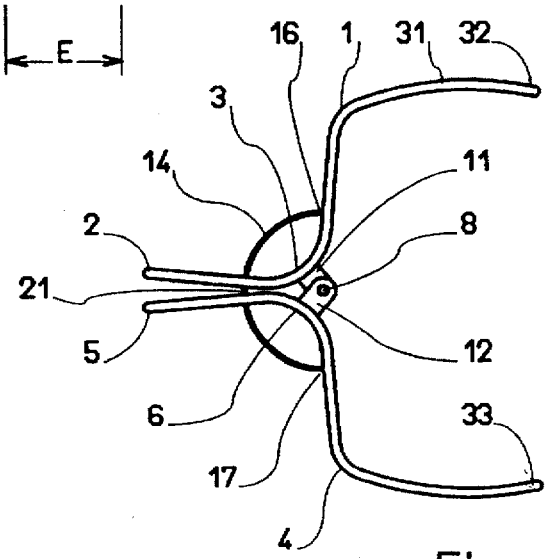
FIG. 6 is a side view of the clip from FIG. 2 shown in the open position.

The first intermediate connecting area 3 and the second intermediate connecting area 6 are linked by hinge means 7 to enable pivoting of the first jaw 1 and the second jaw 4 relative to each other about a transverse hinge axis 8 between an open position shown in FIG. 6 and a closed position shown in FIG. 5. Spring means urge the first jaw 1 and the second jaw 4 towards their closed position.

Figure 4:
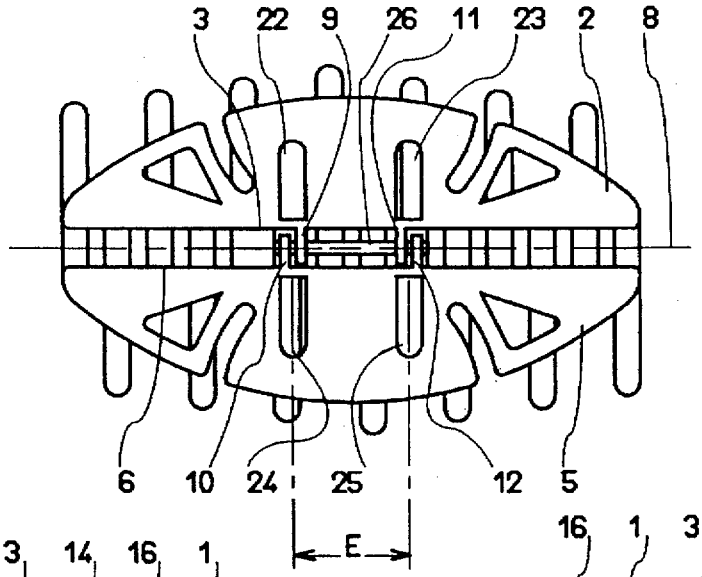
FIG. 4 is a rear view of the hair clip from FIG. 2 with the annular springs and the intermediate tubular member removed.

The hinge means can be seen more clearly in FIGS. 4 through 6. They include a first perforated lug 9 and a second perforated lug 10 respectively projecting beyond the first intermediate connecting area 3 and the second intermediate connecting area 6. The first and second perforated lugs 9, 10 are side by side and close together in the transverse direction along the hinge axis 8, as shown in FIG. 4.

In a similar way, a third perforated lug 11 and a fourth perforated lug 12 respectively project beyond the first intermediate connecting area 3 and the second intermediate connecting area 6 and are side by side and close together in the transverse direction along the hinge axis 8, being spaced in the transverse direction from the first two perforated lugs 9 and 10 with an appropriate spacing E to stabilize the hinge adequately.

The spring means include two open annular springs 13 and 14 disposed about the hinge axis and coaxial with each other, having a common transverse axis parallel to the hinge axis 8. The respective ends, for example the ends 15, 16 and 17 of the annular springs 13 and 14 bear against corresponding housings, for example housings 18 and 19 on the outside surface of the intermediate connecting areas 3 and 6 of the jaws, in front of the hinge axis 8.

The intermediate parts 20 and 21 of the annular springs 13 and 14 pass through respective openings 22, 23, 24 and 25 in the opening levers 2 and 5 and surround the two groups of perforated lugs 9–12 between said levers 2 and 5.

Figure 3:
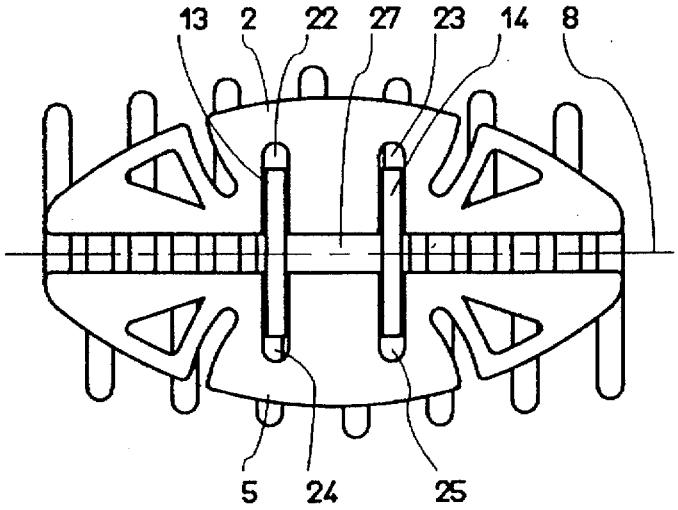
FIG. 3 is a rear view of the hair clip from FIG. 2.

In the embodiment shown in the figures the annular springs 13 and 14 advantageously have a flat cross-section, for example a rectangular cross-section, and their width is greater than the width of each of the groups of perforated lugs 9–12, so that they entirely conceal the perforated lugs in the visible hinge area of width E between the two levers 2 and 5, as shown in FIG. 3.

The annular springs 13 and 14 can be made from metal or any other material having the required elastic properties to produce the necessary force for clamping the jaws 1 and 4 of the clip.

The hinge arrangement also includes a connecting pin 26 passing through the respective perforations in the four perforated lugs 9–12 to couple the two jaws together. The pin 26 defines the hinge axis 8 and can be seen in FIG. 4. In order to pass through the respective perforations in the perforated lugs 9–12 the pin 26 naturally has a diameter smaller than the size of the perforated lugs 9–12. A gap therefore remains between the two intermediate connecting areas 3 and 6, in particular in the gap of width E between the two sets of perforated lugs 9, 10 and 11, 12. In the embodiment shown in FIG. 3 the esthetic appearance of the clip is significantly improved, on its posterior side, by providing a tubular member 27 which fits over the connecting pin 26 and links the two sets of perforated lugs 9, 10 and 11, 12 to conceal the connecting pin 26 in the visible hinge area of width E between the two levers 2 and 5. The tubular member 27 can advantageously be a decorated member, for example it can be a different color than the levers 2 and 5, for example the same color as the annular springs 13 and 14.

The annular springs 13 and 14 are preferably thin, so that they are hard to see edge-on, as can be seen in FIGS. 5 and 6. In the closed position, as shown in FIG. 5, the intermediate parts 20 and 21 of the annular springs 13 and 14 are near the respective sets of perforated lugs 9, 10 and 11, 12 with the result that the perforated lugs 9–12 are concealed to the greatest possible degree.

In the embodiment shown in FIGS. 5 and 6 the annular springs 13 and 14 have a regular curved C-shape profile as seen from the side: in the closed position (FIG. 5) this profile is substantially circular; in the open position (FIG. 6) the profile is an open C-shape.

To prevent deformation of the jaws 1, 4 if the clip is heated, the annular springs 13 and 14 bear in the corresponding housings 18, 19 with a low prestressing force when the clip is in the closed position. Because of the shape of the annular springs 13 and 14, even if the prestressing force is low in the closed position, the annular springs 13 and 14 generate sufficient spring return force when the clip is in the open position. This effect is not obtained with the conventional coil springs.

The jaws 1 and 4 of a clip of the invention can have various shapes, as can the levers 2 and 5.

For example, FIG. 1 shows a clip of the invention in which the jaws 1 and 4 are generally crescent moon shaped, widening transversely, i.e. parallel to the hinge axis 8. In the closed position the anterior lips 28 and 29 of the jaws 1 and 4 bear against each other along their length. For better attachment into the hair a series of interleaving teeth 30 can be provided on the anterior lips 28 and 29. In this embodiment the jaws 1 and 4 form a clip which is generally flat and wide.

Figure 2:
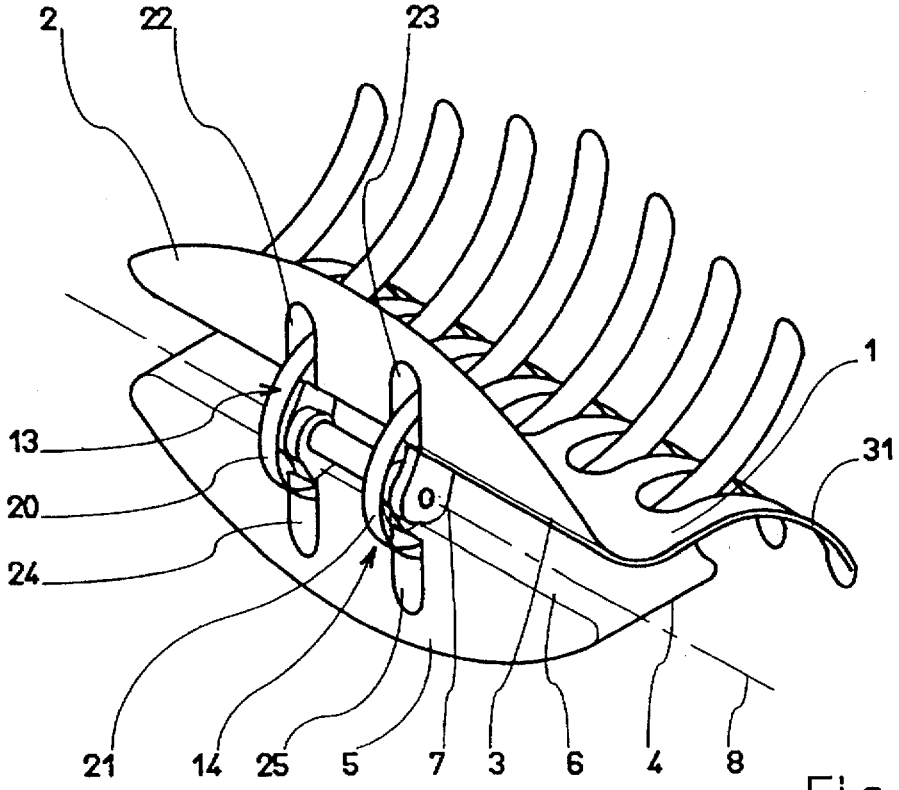
FIG. 2 is a perspective view of a second embodiment of hair clip in accordance with the present invention, shown in the closed position.

In the FIG. 2 embodiment the jaws 1 and 4 form two series of parallel teeth like the teeth 31 curved towards each other and interleaved with each other in the closed position. The longitudinal profile of the teeth 31 can be substantially circular, as shown in FIGS. 5 and 6. When the clip is open (FIG. 6) the ends 32 and 33 of the teeth are spaced apart, for insertion of the clip into the hair. When the clip is in an intermediate position between the open position and the closed position the ends 32 and 33 of the two sets of teeth face each other, crossing over when the clip moves to the closed position.

The levers 2 and 5 can be of various shapes, for example a crescent moon shape as shown in FIGS. 3 and 4, or a more rectangular shape as shown in FIG. 1, with decorative openings, a worked contour or decoration applied to the posterior side.

The present invention is not limited to the embodiments that have been specifically described but encompasses variants and generalizations thereof within the scope of the following claims.

There is claimed:

1. Hair clip comprising:

a first jaw operable by a first opening lever to which it is attached in a first intermediate connecting area, a second jaw operable by a second opening lever to which it is attached in a second intermediate connecting area, hinge means connecting said first and second intermediate connection areas to enable pivoting of said first and second jaws relative to each other about a transverse hinge axis between an open position and a closed position, spring means for urging said first and second jaws toward their closed position, wherein said hinge means include perforated lugs respectively projecting beyond said first and second intermediate connecting areas and a coupling pin extending through the perforated lugs to connect together said two jaws, wherein said spring means include two open annular springs disposed around said hinge axis and coaxial with each other, the annular springs having a width and having a common transverse axis parallel to said hinge axis, their respective ends bearing in corresponding housings on outside surfaces of said intermediate connecting areas of said jaws in front of said hinge axis and their intermediate parts extending through corresponding openings in said opening levers and surrounding the perforated lugs between said levers, wherein the openings in said opening levers are elongated openings having a length which is generally perpendicular to the hinge axis and a width which is slightly wider than the width of the annular springs.

2. The clip according to claim 1, wherein said annular springs are wider than the perforated lugs to conceal said perforated lugs entirely in the hinge area visible between said two levers.

3. The clip according to claim 1, wherein, in said closed position, said intermediate part of each annular spring is near the respective perforated lugs.

4. The clip according to claim 1, wherein said annular springs are thin so that they are difficult to see edge-on.

5. The clip according to claim 1, wherein, in said closed position, said annular springs bear in corresponding housings with a low prestressing force.

6. The clip according to claim 1, wherein said jaws form a generally flat and wide clip with anterior lips which bear on each other in said closed position.

7. The clip according to claim 1, wherein said jaws form two series of parallel teeth curving towards each other and interleaving in said closed position.

8. The clip according to claim 7, wherein the ends of said teeth of said two series of teeth face each other when said clip is in an intermediate position between said open position and said closed position.

9. Hair clip comprising:

a first jaw operable by a first opening lever to which it is attached in a first intermediate connecting area, a second jaw operable by a second opening lever to which it is attached in a second intermediate connecting area, hinge means connecting said first and second intermediate connection areas to enable pivoting of said first and second jaws relative to each other about a transverse hinge axis between an open position and a closed position, spring means for urging said first and second jaws toward their closed position, wherein said spring means include two open annular springs disposed around said hinge axis and coaxial with each other, the annular springs having a width and having a common transverse axis parallel to said hinge axis, their respective ends bearing in corresponding housings on outside surfaces of said intermediate connecting areas of said jaws in front of said hinge axis and their intermediate parts extending through corresponding openings in said opening levers, wherein the openings in said opening levers are elongated openings having a length which is generally perpendicular to the hinge axis and a width which is slightly wider than the width of the annular springs.

10. The hair clip of claim 9, wherein the elongated openings have first and second ends, and wherein in the closed position the intermediate part of each annular spring is near the first end of the openings, and wherein in the open position the intermediate part of each annular spring is near the second end of the openings.

11. Hair clip comprising:

a first jaw operable by a first opening lever, a second jaw operable by a second opening lever, hinge means connecting said first and second jaws to enable pivoting of said first and second jaws relative to each other between an open position and a closed position, the hinge means defining a hinge axis, and spring means for urging said first and second jaws toward their closed position, wherein the spring means include two open annular springs disposed around said hinge axis and coaxial with each other, the annular springs having a width and having a common transverse axis parallel to said hinge axis, wherein the annular springs extend through openings in said opening levers, and wherein the openings in said opening levers are elongated openings having a length which is generally perpendicular to the hinqe axis and a width which is slightly wider than the width of the annular springs.

12. The hair clip of claim 11, wherein the elongated openings have first and second ends, and wherein in the closed position a portion of each annular spring is near the first end of the openings, and wherein in the open position a portion of each annular spring is near the second end of the openings.

13. Hair clip comprising:

a first jaw operable by a first opening lever to which it is attached in a first intermediate connecting area, a second jaw operable by a second opening lever to which it is attached in a second intermediate connecting area, the first and second jaws both having a plurality of teeth extending therefrom, hinge means connecting said first and second intermediate connection areas to enable pivoting of said first and second jaws relative to each other about a transverse hinge axis between an open position and a closed position, and spring means for urging said first and second jaws toward their closed position, wherein said spring means includes an open annular spring disposed around said hinge axis, the annular spring having a width and having a transverse axis parallel to said hinge axis, the annular spring having respective ends bearing in corresponding housings on outside surfaces of said intermediate connecting areas of said jaws in front of said hinge axis and having an intermediate part extending through corresponding openings in said opening levers, wherein the openings in said opening levers are elongated openings having a length which is generally perpendicular to the hinge axis and a width which is slightly wider than the width of the annular spring, and wherein the elongated openings have first and second ends, and wherein in the closed position the intermediate part of the annular spring is near the first end of the openings, and wherein in the open position the intermediate part of the annular spring is near the second end of the openings.

14. Hair clip comprising:

a first jaw operable by a first opening lever, a second jaw operable by a second opening lever, the first and second jaws both having a plurality of teeth extending therefrom, hinge means connecting said first and second jaws to enable pivoting of said first and second jaws relative to each other between an open position and a closed position, the hinge means defining a hinge axis, and spring means for urging said first and second jaws toward their closed position, wherein the spring means includes an open annular spring disposed around and coaxial with said hinge axis, the annular spring having a width, wherein the annular spring extends through openings in said opening levers, and wherein the openings in said opening levers are elongated openings having a length which is generally perpendicular to the hinge axis and a width which is slightly wider than the width of the annular spring, and wherein the elongated openings have first and second ends, and wherein in the closed position a portion of the annular spring is near the first end of the openings, and wherein in the open position a portion of the annular spring is near the second end of the openings.

* * * * *